US006176295B1

(12) United States Patent
Pleschiutschnigg

(10) Patent No.: US 6,176,295 B1
(45) Date of Patent: Jan. 23, 2001

(54) PLATE MOLD FOR PRODUCING STEEL BILLETS

(75) Inventor: Fritz-Peter Pleschiutschnigg, Duisburg (DE)

(73) Assignee: Mannesmann Aktiengesellschaft, Düsseldorf (DE)

( * ) Notice: Under 35 U.S.C. 154(b), the term of this patent shall be extended for 0 days.

(21) Appl. No.: 09/011,344

(22) PCT Filed: Jul. 29, 1996

(86) PCT No.: PCT/DE96/01445

§ 371 Date: Mar. 11, 1998

§ 102(e) Date: Mar. 11, 1998

(87) PCT Pub. No.: WO97/04900

PCT Pub. Date: Feb. 13, 1997

(30) Foreign Application Priority Data

Aug. 2, 1995 (DE) ..... 195 29 931

(51) Int. Cl.[7] ..... B22D 11/04; B22D 11/16

(52) U.S. Cl. ..... 164/154.7; 164/416; 164/436; 164/452; 164/478; 164/491

(58) Field of Search ..... 164/154.7, 416, 164/436, 452, 451, 478, 491

(56) References Cited

U.S. PATENT DOCUMENTS

| | | | | |
|---|---|---|---|---|
| 3,926,244 | * | 12/1975 | Meier et al. | 164/491 X |
| 4,553,604 | * | 11/1985 | Yaji et al. | 164/491 X |
| 5,242,010 | * | 9/1993 | Pleschiutschnigg et al. | 164/452 |
| 5,836,375 | * | 11/1998 | Thöne et al. | 164/452 |

FOREIGN PATENT DOCUMENTS

| | | | | |
|---|---|---|---|---|
| 2015806 | * | 7/1994 | (RU) | 164/154.7 |
| 917899 | * | 4/1982 | (SU) | 164/154.7 |

* cited by examiner

*Primary Examiner*—J. Reed Batten, Jr.
(74) *Attorney, Agent, or Firm*—Cohen, Pontani, Lieberman & Pavane

(57) ABSTRACT

The plate mold has water-cooled narrow side walls that can be clamped between broad side walls. The broad side walls have at least three adjacent and mutually independent cooling segments. The cooling segments are divided symmetrically relative to the central axis of the mold and have, in the region of the mold mouth, separate connections for the independent supply of a liquid coolant. The apparatus includes temperature sensors, an oscillation device, an actuator for adjusting the space between the narrow and broad side walls and a control device connected to the temperature sensors to control the oscillation device and the actuator.

3 Claims, 2 Drawing Sheets

PLATE MOLD FOR PRODUCING STEEL BILLETS

BACKGROUND OF THE INVENTION

1. Field of the Invention

The invention relates to a plate mold for producing steel billets, in particular thin slabs, with water-cooled narrow side walls that can be clamped between broad side walls. Such a mold further has devices for adjusting the hollow space formed by the narrow side wall and broad side walls for different billet sizes and to adjust the casting taper, and still further has an oscillation device.

2. Discussion of the Prior Art

From German reference DE 24 15 224 C3, a plate mold for slabs is known, the mold walls of which have cooling chambers that encompass certain cooling areas. Measurement elements are attached to water supply and discharge lines of the broad sides to determine the extracted heat quantity or cooling rates. At the same time, an average value for the cooling rate of the cooling chambers is formed in the measurement elements, which is supplied to an averaging device, with which the taper of the narrow sides can be controlled.

It is known from German reference DE 41 17 073 C2 to determine, with the help of calorimetric measurements taken on a slab mold, particularly a rectangular or convex thin slab mold, the integral and specific heat transfer on each individual copper plate. A "one line" comparison of the specific heat flow from the copper plate side facing the steel, known as the "hot face," to the water-cooled side, specifically of the narrow sides, with those of the two broad sides, permits the narrow side taper to be controlled independent of the individually selected casting parameters.

Disadvantageously, in the aforementioned plate molds, no differentiated statements can be made about the partial heat flow over the breadth of the mold. Furthermore, the temperature sensors used are not suitable for reliable casting at casting speeds above 1.5 m/min.

SUMMARY OF THE INVENTION

The object of the present invention is therefore to provide a plate mold for casting speeds between 1.5 and 8 m/min that permits simple and reliable temperature control in the area of the immersion nozzle, including the broad side center.

Pursuant to this object, and others which will become apparent hereafter, one aspect of the present invention resides in a plate mold for producing steel billets, which mold is comprised of opposed broad side walls, water-cooled narrow side walls arranged between the broad side walls so that a mold mouth is formed. The broad side walls are divided into at least three adjacent and mutually independent cooling segment chambers. The broad side walls are divided symmetrically relative to a central axis of the mold. In a region of the mold mouth each of the cooling chambers has separate connections for supplying a liquid cooling medium. Actuator means are provided for adjusting a hollow space formed by the narrow side walls and the broad side walls to two different billet sizes as well as to adjust casting taper. An oscillating device is provided for oscillating the mold. A first temperature sensor is provided in one of the walls of the chambers which faces the billet for the purpose of detecting at least a temperature difference between the individual chambers. A second temperature sensor is provided for sensing the temperature of the connection for liquid cooling medium. Control means are connected to the first temperature sensor means and the second temperature means, as well to the actuator means for controlling the taper of the narrow side walls and/or balancing specific heat flows per chamber relative to each other by changing oscillation parameters.

According to the invention, the broad side walls are divided into at least three independent cooling segments in the longitudinal direction. The cooling segments are arranged so that the segments on the outside have identical structures and enclose between them a central segment, which can be divided into several zones.

This arrangement allows differentiated statements to be made about the partial heat flow over the mold breadth. The heat flow differences over the slab breadth are thus taken into account, so that the underlying measurements can be partially collected over the breadth and height of the mold in integral fashion. To ensure the reliable casting of slabs, particularly thin slabs and particularly at casting speeds between 1.5 and 8 m/min, it is important to know the specific heat transfer of the broad sides, particularly in the slab center. This knowledge makes it possible to achieve uniform cooling in the region of the immersion nozzle, relative to the rest of the broad sides and to the narrow sides, and to avoid malfunctions caused by the following factors:

- flow shadows caused by the immersion nozzle;
- relative slag shortage and thus insufficient lubricant film density, due to reduced active
- thickness over the breadth of slab, for melting casting powder into casting slag;
- high membrane effect of the strand shell in the slab center;
- flow symmetry relative to the central axis of the billet in the casting direction; and
- turbulence of the casting level or surface over the breadth of the slab.

To determine a differentiated specific heat flow density over the breadth of the mold and in the region of the narrow sides or over the slab, and thus to attain the possibility of exercising influence on reliable casting, actuators are used to control the following:

- taper
- immersion nozzle position and thus immersion depth during casting; and
- assessment of the possible resultant flow change in the immersion nozzle, e.g., due to oxide deposits.

In addition, it is possible to optimize both the immersion nozzle and the mold shape, individually or together.

Measuring the water discharge temperature in comparison to the supply temperature within the three individual zones makes it possible to optimize the cooling water control. The temperatures of the supply and discharge water as well as the water quantity are measured in each zone, whereby the water quantities can also be controlled independent of each other.

The arrangement according to the invention in at least three zones and the comparison of the specific heat flows in these zones to each other allow an asymmetry, especially to that in the immersion nozzle region, to be recognized. A non-uniform heat transfer resulting from turbulence of the steel in the mold can also be recognized.

A possible deviation in the mold center is associated with longitudinal cracks in the billet surface to the point of breakthrough (stickers). Such longitudinal cracks occur particularly in the central slab region along the central axis near the immersion nozzle, i.e., in the area of a relatively thin slag lubricating film. This thinner slag lubricating film leads to an increased heat flow and thus to non-uniform partial strand shell formation, in view of the higher density, reduced temperature and increased shrinkage. Such non-uniform partial strand shell formation results in longitudinal cracks, and in extreme cases, the billet sticks in the center of the mold broad side and breakthrough occurs. Parallel to these disturbances on the billet shell, corresponding thermal partial stresses occur on the copper plate, which reduce the service life. Moreover, the device allows the migration of the billet in the direction of one of the narrow sides, with the accompanying risk of breakthrough due to hangers, to be recognized, and then counteracted by conicity control.

The deviation of the specific heat flow (measured in kcal/min. $m^2$ or $MW/m^2$) in the central zone compared to the edge zones provides a direct measure for the adjusting element with respect to:

narrow side conicity cooling water quantity per cooling zone stroke height, frequency and/or oscillation, and shape of mold oscillation depth of the immersion nozzle during casting.

The knowledge gained in this way leads to optimization of:

the mold shape the casting slag and the immersion nozzle shape, inside and outside, in conjunction with the mold shape.

Thus, the invention not only allows the casting parameters to be changed during casting, especially for the purpose of breakthrough protection, but also permits the development of the mold shape in conjunction with the immersion nozzle shape, both inside and outside, and of the casting powder to form an optimal "mold" system.

BRIEF DESCRIPTION OF THE DRAWINGS

An example of the invention is shown in the accompanying drawings.

DETAILED DESCRIPTION OF THE PREFERRED EMBODIMENTS

Figure 1:
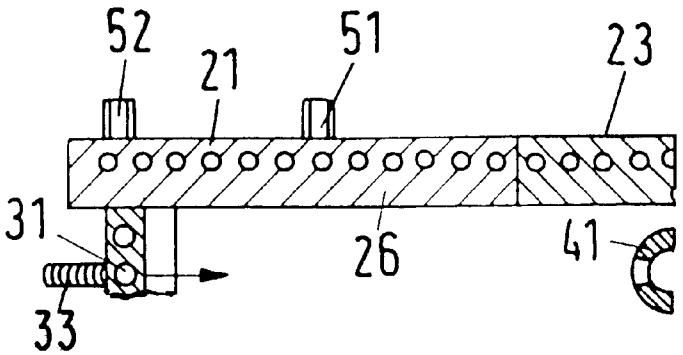
Figure 2:
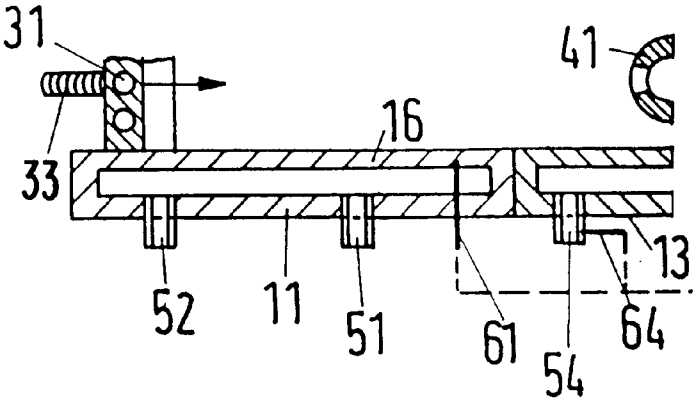
Figure 7:
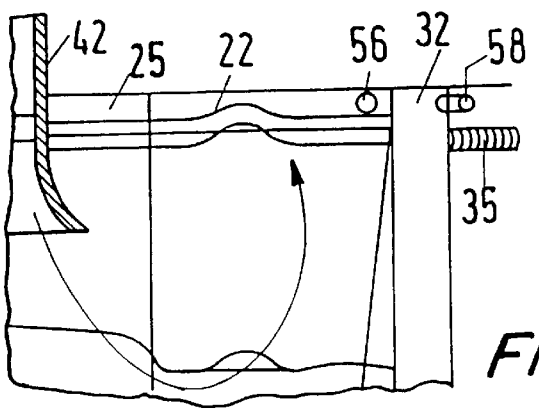
FIGS. 5–8 show the structure of a plate mold in longitudinal section.
Figure 8:
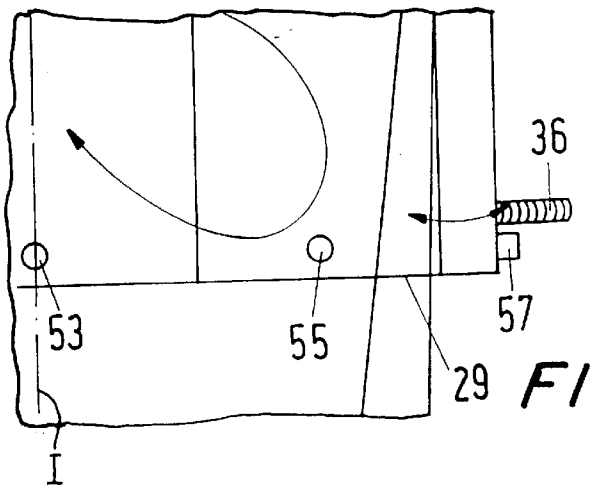
Figure 5:
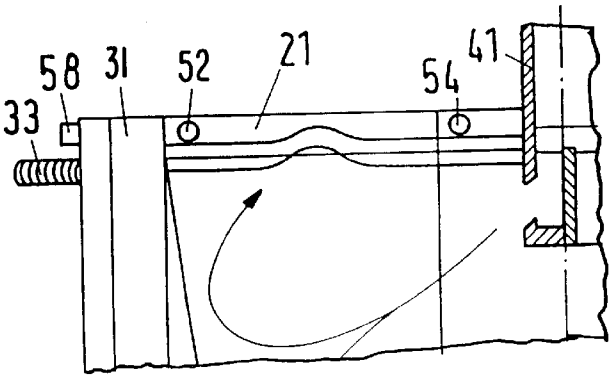
Figure 6:
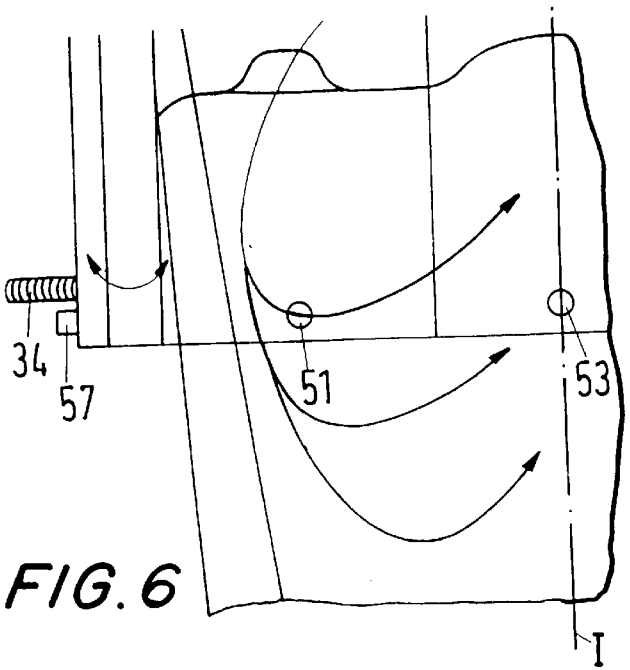

FIGS. 1–4, show sections of the mold viewed from above. FIGS. 1 and 2 show a straight-walled mold for the continuous casting of slabs. The broad sides have a first side segment 11 and a middle segment 13 as in FIG. 2, each of which has chambers, or a first segment 21 and a middle segment 23 that have vertical borings to conduct the cooling water, as in FIG. 1.

Clamped between the broad sides is a narrow side 31, which is adjustable via an adjustment device 33, 34.

Figure 3:
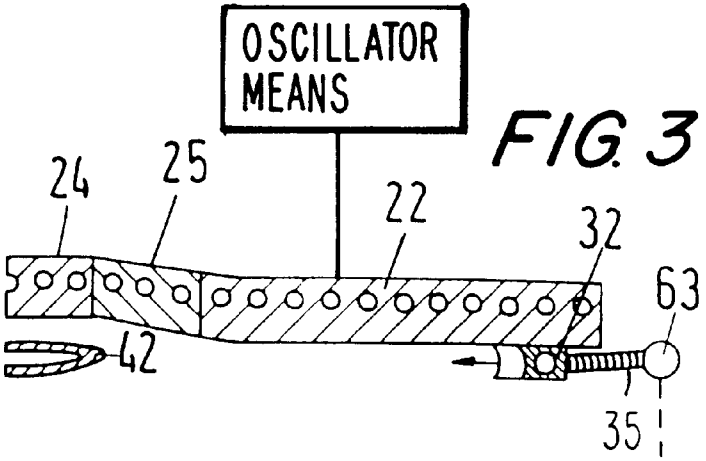
FIGS. 1–4 show, in schematic fashion, the structure of a plate mold in cross-section.
Figure 4:
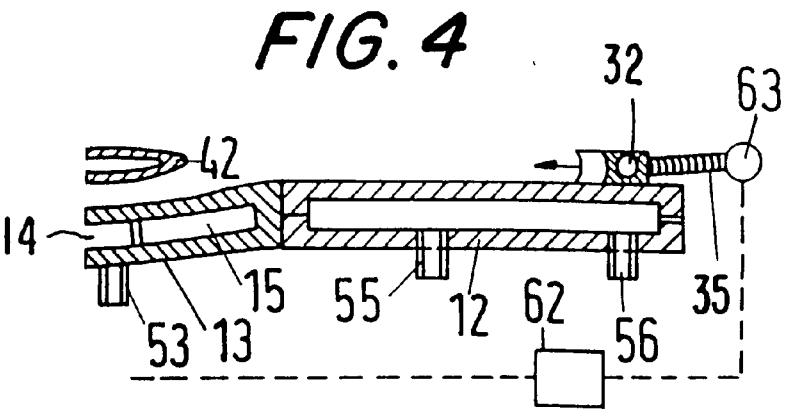

FIGS. 3 and 4 show what is called a curved mold. The curved mold has a broad segment 12 and a middle segment 13, each of which has cooling chambers as shown in FIG. 4, or a side segment 22 and a middle segment 23, which has cooling borings as in FIG. 3. In the present example, the middle segments 13 or 23 are further divided into the zones 14 and 15 or 24 and 25.

Clamped between the broad sides 12 and 22 is a curved narrow side 32, which is adjustable via an adjustment device 35, 36 by means of an actuator 63.

The broad side segments 11 to 15 or 21 to 25 and the narrow sides 31 and 32 have supply lines 51, 53, 55, 57 and discharge lines 52, 54, 56 and 58, through which a cooling medium can be supplied and extracted.

A cylindrical immersion casting tube 41 or 42 a flattened immersion casting tube is located in the inner space of the mold along the central axis. Thermal sensors 61 are arranged in the wall 16 or 26 of the mold facing the inner space, and thermal sensors 64 are placed into the supply and discharge lines 51 to 58. The sensors 61 and 64 are connected to a controller 62, which acts upon the actuator 63 or an oscillation device 70.

FIGS. 5–8 show side views of the mold with the same items referred to above. In addition thereto, the lower adjustment device 34 or 36 of the narrow sides 31 or 32 is also shown.

Further, the mold mouth is identified by 29.

I claim:

1. A plate mold for producing a steel billet, comprising:

opposed broad side walls;

water-cooled narrow side walls arranged between the broad side walls so that a mold mouth is formed, the broad side walls being divided into at least three adjacent and mutually independent cooling segment chambers, the broad side walls being divided symmetrically relative to a central axis of the mold, and having, in a region of the mold mouth, separate connections for independent supply of a liquid cooling medium;

actuator means for adjusting a hollow space formed by the narrow side walls and the broad side walls to different billet sizes as well as to adjust casting taper;

means for oscillating the mold;

first temperature sensor means provided in one of the walls of the chambers facing the billet for detecting at least a temperature difference between the individual chambers;

second temperature sensing means for sensing temperature at the connection for liquid cooling medium; and control means, connected to the first temperature sensor means, the second temperature sensor means and the actuator means, for controlling the taper of the narrow side walls via the actuator means and balancing specific heat flows per chamber relative to each other by changing oscillation parameters of the mold.

2. A plate mold as defined in claim 1, wherein the cooling segment chambers are configured as cooling chambers.

3. A plate mold as defined in claim 2, wherein the chambers include outermost chambers in the broad side walls that are configured to have identical structures, and a middle chamber that is divided into further zones oriented in a longitudinal direction.

* * * * *